US009470241B2

(12) United States Patent
Kobayashi et al.

(10) Patent No.: US 9,470,241 B2
(45) Date of Patent: Oct. 18, 2016

(54) CENTRIFUGAL BLOWER AND VEHICLE AIR CONDITIONER PROVIDED WITH THE SAME

(75) Inventors: Takayuki Kobayashi, Tokyo (JP); Kenichi Terauchi, Tokyo (JP); Atsushi Suzuki, Tokyo (JP); Tomohiko Shibata, Tokyo (JP); Junichiro Hara, Tokyo (JP); Yasuhiro Watanabe, Tokyo (JP); Kazuyuki Kamiya, Nagoya (JP)

(73) Assignee: Mitsubishi Heavy Industries Automotive Thermal Systems Co., Ltd., Kiyosu-shi (JP)

( * ) Notice: Subject to any disclaimer, the term of this patent is extended or adjusted under 35 U.S.C. 154(b) by 234 days.

(21) Appl. No.: 14/002,287

(22) PCT Filed: May 24, 2012

(86) PCT No.: PCT/JP2012/063329

§ 371 (c)(1),
(2), (4) Date: Aug. 29, 2013

(87) PCT Pub. No.: WO2012/169365

PCT Pub. Date: Dec. 13, 2012

(65) Prior Publication Data

US 2013/0336819 A1 Dec. 19, 2013

(30) Foreign Application Priority Data

Jun. 10, 2011 (JP) ..... 2011-129727

(51) Int. Cl.
*F04D 29/40* (2006.01)
*F04D 29/42* (2006.01)
(Continued)

(52) U.S. Cl.
CPC ..... *F04D 29/422* (2013.01); *F04D 29/086* (2013.01); *F04D 29/426* (2013.01); *F04D 29/4226* (2013.01); *F04D 29/705* (2013.01); *F04D 29/708* (2013.01)

(58) Field of Classification Search
CPC .... F04D 29/40; F04D 29/42; F04D 29/4226; F04D 29/086; F04D 29/422; F04D 29/708; F04B 53/16
USPC ..... 417/423.14
See application file for complete search history.

(56) References Cited

U.S. PATENT DOCUMENTS 2,284,456 A * 5/1942 Stoddard ..... A47L 15/06 134/186
6,558,140 B2 * 5/2003 Suzuki et al. ..... 417/423.1

(Continued)

FOREIGN PATENT DOCUMENTS

CN 101052810 A 10/2007
CN 101083413 A 12/2007

(Continued)

OTHER PUBLICATIONS

International Search Report dated Aug. 28, 2012, issued in correponding application No. PCT/JP2012/063329.

(Continued)

*Primary Examiner* — Charles Freay
*Assistant Examiner* — Philip Stimpert
(74) *Attorney, Agent, or Firm* — Westerman, Hattori, Daniels & Adrian, LLP

(57) ABSTRACT

A centrifugal blower includes a centrifugal fan; an electric motor that rotationally drives the centrifugal fan; a fan case that has an air inlet and an air outlet and that internally accommodates the centrifugal fan; and an electric motor case (8) that has a cylinder (6) accommodating the electric motor and a flange portion (7) extending radially outward from the cylinder (6) and that is fitted to the fan case. The flange portion (7) is provided with a ring-shaped rib portion (20) that protrudes from the flange portion (7); the ring-shaped rib portion (20) is provided with a plurality of slits (22*a* and 22*b*) that extend from the flange portion (7) in the axial direction of the cylinder (6); and the flange portion (7) between the ring-shaped rib portion (20) and the cylinder (6) is inclined in a circumferential direction toward the slits (22*a* and 22*b*).

6 Claims, 3 Drawing Sheets

(51) Int. Cl.
*F04D 29/70* (2006.01)
*F04D 29/08* (2006.01)

(56) References Cited

U.S. PATENT DOCUMENTS

| | | | | |
|---|---|---|---|---|
| 2002/0154993 | A1* | 10/2002 | Kamiya et al. | 415/204 |
| 2008/0317586 | A1 | 12/2008 | Kuma | |
| 2011/0116928 | A1 | 5/2011 | Czulak et al. | |

FOREIGN PATENT DOCUMENTS

| | | | |
|---|---|---|---|
| DE | 102009039783 | A1 | 4/2010 |
| EP | 1 178 215 | A2 | 2/2002 |
| JP | 05-91923 | U | 12/1993 |
| JP | 2755317 | B2 | 5/1998 |
| JP | 2005-240640 | A | 9/2005 |
| JP | 2007-154856 | A | 6/2007 |
| JP | 3968878 | B2 | 8/2007 |
| JP | 4116359 | B2 | 7/2008 |
| JP | 2008-297916 | A | 12/2008 |
| JP | 2008-297917 | A | 12/2008 |
| WO | 2011/055594 | A1 | 5/2011 |

OTHER PUBLICATIONS

Written Opinion dated Aug. 28, 2012, issued in corresponding application No. PCT/JP2012/063329.
Office Action dated Dec. 22, 2014, issued in German Application No. 112012002419.2. w/English translation. (8 pages).
Office Action dated May 22, 2015, issued in counterpart Chinese Patent Application No. 201280011147.X, with English translation (11 pages).
Decision to Grant a Patent dated May 12, 2015, issued in counterpart Japanese Patent Application No. 2011-129727 (3 pages). Explanation of Relevance—"The Decision to Grant a Patent has been received.".
Decision of a Patent Grant dated Feb. 1, 2016, issued in counterpart Chinese Patent Application No. 201280011147.X, with English translation (4 pages). Concise English Language Explanation of Relevance: The Notification on the Grant of Patent Right for Invention has been received.

* cited by examiner

CENTRIFUGAL BLOWER AND VEHICLE AIR CONDITIONER PROVIDED WITH THE SAME

TECHNICAL FIELD

The present invention relates to a centrifugal blower and a vehicle air conditioner provided with the same, and it relates in particular to discharging of water that has penetrated a centrifugal blower.

BACKGROUND ART

In general, with a centrifugal blower of a vehicle air conditioner, there is a risk of rainwater, water present while washing the vehicle, and so forth penetrating the interior of a motor from an air inlet that introduces air into the centrifugal blower. Because of this, a flange portion of a motor case holding the motor of the centrifugal blower is provided with a ring-shaped protrusion that protrudes toward a fan case, and, in addition, a discharging groove for discharging water is provided (for example, Patent Literature 1 to 3).

CITATION LIST

Patent Literature

{PTL 1} Publication of Japanese Patent No. 2755317
{PTL 2} Publication of Japanese Patent No. 3968878
{PTL 3} Japanese Unexamined Patent Application, Publication No. 2007-154856

SUMMARY OF THE INVENTION

Technical Problem

However, with the inventions disclosed in Patent Literature 1 to 3, because the water dischargeability from the centrifugal blower is not sufficient, there is a risk of creating a situation in which water is accumulated when a vehicle provided with a vehicle air conditioner becomes inclined.

The present invention has been conceived in order to solve the above-described problems, and an object thereof is to provide a centrifugal blower having sufficient water dischargeability even when a vehicle becomes inclined, as well as a vehicle air conditioner provided with the same.

Solution to Problem

In order to achieve the above-described object, the present invention provides the following solutions.

Specifically, a centrifugal blower according to a first aspect of the present invention is a centrifugal blower including a centrifugal fan; an electric motor that rotationally drives the centrifugal fan; a fan case that has an air inlet and an air outlet and that internally accommodates the centrifugal fan; and an electric motor case that has a cylinder accommodating the electric motor and a flange portion extending radially outward from the cylinder and that is fitted to the fan case, wherein the flange portion is provided with, in a concentric manner with the cylinder, a ring-shaped rib portion that protrudes from the flange portion; the ring-shaped rib portion is provided with a slit that extends from the flange portion in the axial direction of the cylinder; and the flange portion between the ring-shaped rib portion and the cylinder is inclined in a circumferential direction toward the slit.

The flange portion provided at the outer circumference of the cylinder that accommodates the electric motor is provided with, in a concentric manner with the cylinder, the ring-shaped rib portion that protrudes from the flange portion, and the ring-shaped rib portion is provided with the slit that extends from the flange portion in the axial direction of the cylinder. In addition, the flange portion between the ring-shaped rib portion and the cylinder is inclined in the circumferential direction toward the slit. By doing so, water guided to the flange portion between the ring-shaped rib portion and the cylinder can be easily guided to the slit along the inclined flange portion so as to be discharged to the outer circumferential side of the ring-shaped rib portion. Therefore, it is possible to increase the water dischargeability even when the centrifugal blower becomes inclined.

In addition, in the centrifugal blower according to the above-described aspect, an extension end portion of the ring-shaped rib portion is inclined downward from an outer circumference of the extension end portion toward an inner circumference thereof.

The ring-shaped rib portion having the extension end portion whose shape is inclined downward from the outer circumference to the inner circumference is employed. By doing so, when water enters the inner circumferential side of the ring-shaped rib portion from the outer circumference of the ring-shaped rib portion, the outer circumference of the extension end portion of the ring-shaped rib portion inhibits retention of water at the extension end portion of the ring-shaped rib portion, and thus, water can easily be made to fall between the ring-shaped rib portion and the cylinder along the downward inclination of the extension end portion. Accordingly, it is possible to suppress splashing toward the electric motor due to spattering of water retained at the extension end portion of the ring-shaped rib portion. Therefore, it is possible to suppress water penetration into the electric motor.

In addition, in the centrifugal blower according to the above-described aspect, a predetermined space is formed between the extension end portion of the ring-shaped rib portion and the centrifugal fan when the fan case and the electric motor case are fitted together.

The predetermined space is formed between the centrifugal fan and the extension end portion of the ring-shaped rib portion when the fan case and the electric motor case are fitted together. By doing so, it is possible to prevent the extension end portion of the ring-shaped rib portion from interfering with the centrifugal fan when the centrifugal fan is rotationally driven. Therefore, it is possible to reliably drive the centrifugal blower.

Note that the predetermined space is such that the extension end portion of the ring-shaped rib portion does not interfere with the centrifugal fan, and is set to be, for example, about 2 mm or greater.

In addition, in the centrifugal blower according to the above-described aspect, the width of the slit is equal to or greater than 1 mm and equal to or less than 3 mm.

If the slit width is too wide (too large), water penetrates into the space between the ring-shaped rib portion and the cylinder from the slit. In addition, if the slit width is too narrow (too small), it is difficult to expel water from between the ring-shaped rib portion and the cylinder toward the outer circumference of the ring-shaped rib portion.

Thus, the slit width is set to be equal to or greater than 1 mm and equal to or less than 3 mm. By doing so, it is possible to easily expel water from between the ring-shaped rib portion and the cylinder, and it is also possible to prevent the water penetration via the slit. Therefore, it is possible to prevent water penetration toward the electric motor and also to ensure sufficient water dischargeability.

In addition, in the centrifugal blower according to the above-described aspect, the fan case is formed so as to surround the centrifugal fan in a spiral shape with a tongue portion thereof serving as the origin; and the slit is provided at a position outside of front and rear predetermined angles centered on the tongue portion when the fan case and the electric motor case are fitted together.

In the vicinity of the tongue portion, there is a risk of the rotationally driven centrifugal fan generating a water flow (reverse flow) toward the flange portion located on the radially inner side of the tongue portion.

Thus, the slit is provided so as to be positioned outside of the front and rear predetermined angles centered on the tongue portion when the fan case and the electric motor case are fitted together. By doing so, it is possible to prevent water penetration toward the electric motor from the vicinity of the tongue portion where a reverse flow tends to occur. Therefore, it is possible to ensure sufficient water dischargeability and also to prevent water penetration.

In addition, a vehicle air conditioner according to a second aspect of the present invention is provided with one of the centrifugal blowers described above.

A centrifugal blower from which water can be discharged even when inclined is employed. Therefore, it is possible to maintain the water dischargeability of a vehicle air conditioner even when a vehicle becomes inclined.

Advantageous Effects of Invention

As described above, in a centrifugal blower according to the present invention, a flange portion provided at the outer circumference of a cylinder that accommodates an electric motor is provided with, in a concentric manner with the cylinder, a ring-shaped rib portion that protrudes from the flange portion, and the ring-shaped rib portion is provided with a slit that extends from the flange portion in the axial direction of the cylinder. In addition, the flange portion between the ring-shaped rib portion and the cylinder is inclined in the circumferential direction toward the slit. By doing so, water guided to the flange portion between the ring-shaped rib portion and the cylinder can be easily guided to the slit along the inclined flange portion so as to be discharged to the outer circumferential side of the ring-shaped rib portion. Therefore, it is possible to increase the water dischargeability even when the centrifugal blower becomes inclined.

DESCRIPTION OF EMBODIMENT

An embodiment of the present invention will be described below with reference to FIGS. 1 to 5.

Figure 1:
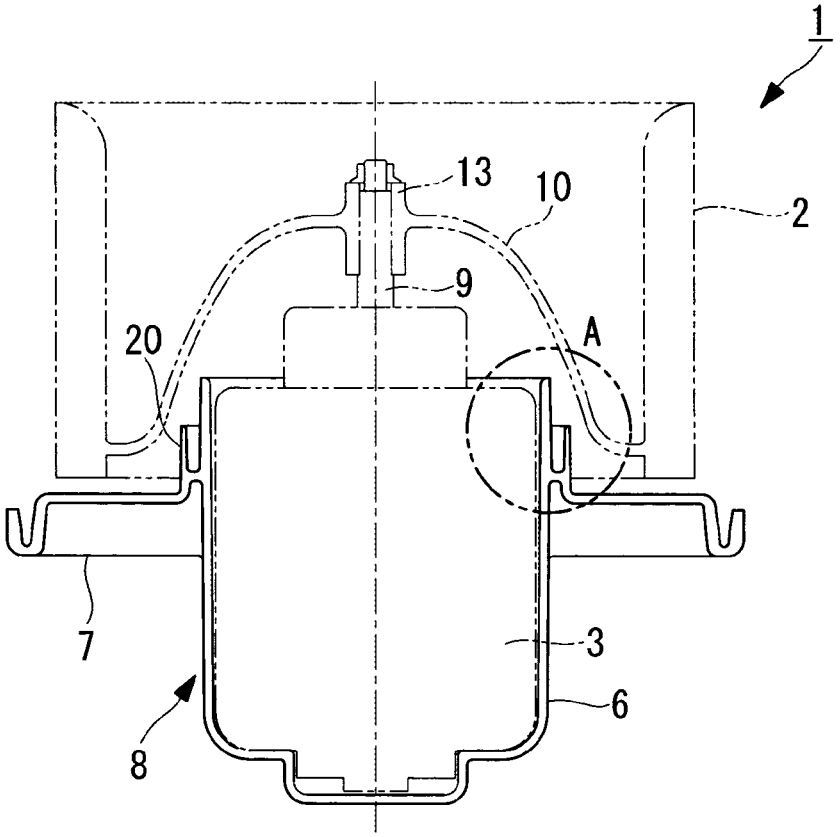
FIG. 1 is a diagram schematically showing, in longitudinal sectional view, the configuration of a centrifugal blower of a vehicle air conditioner according to an embodiment of the present invention.

FIG. 1 is a diagram schematically showing, in longitudinal sectional view, the configuration of a centrifugal blower of a vehicle air conditioner according to the embodiment of the present invention. This centrifugal blower 1 is provided with a centrifugal fan 2; a fan motor (electric motor) 3 that rotationally drives the centrifugal fan 2; a fan case 5 (see FIG. 3) that has an air inlet (not shown) and an air outlet 4 (see FIG. 3) and that internally accommodates the centrifugal fan 2; a motor support cylinder (cylinder) 6 that internally accommodates the fan motor 3; and a motor case (electric motor case) 8 that has a motor flange (flange portion) 7 that extends radially outward from the motor support cylinder 6.

Figure 3:
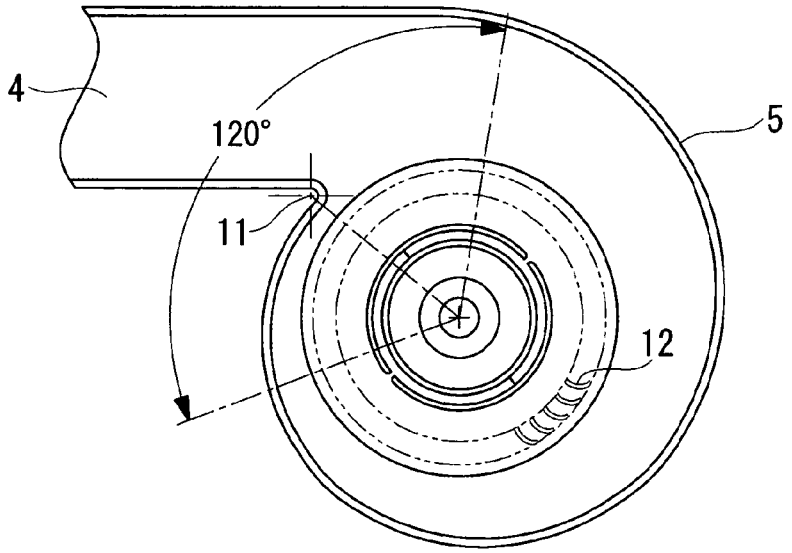
FIG. 3 is a diagram schematically showing the configuration of the centrifugal blower in FIG. 1, as viewed from above.
Figure 4:
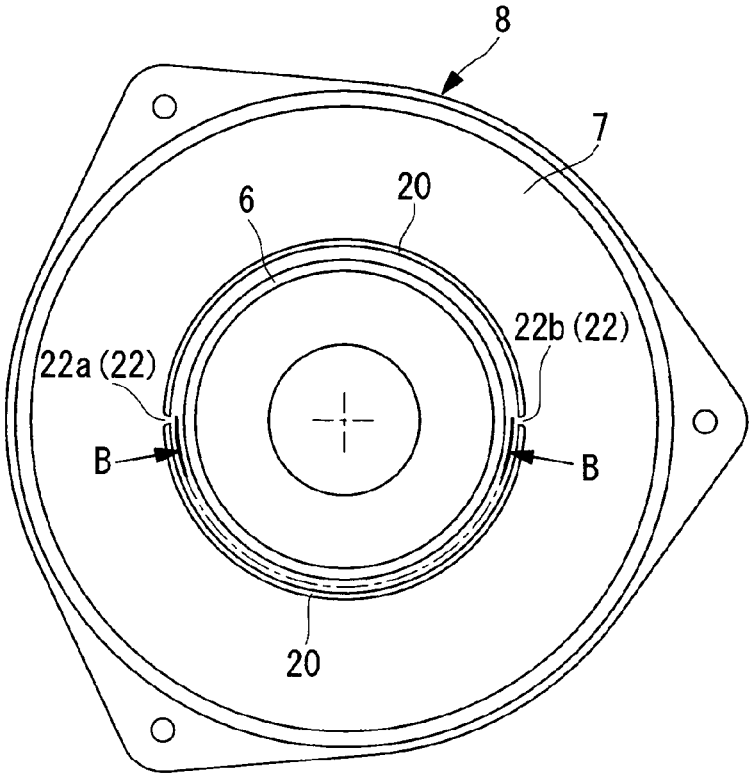
FIG. 4 is a top view of a motor case of the centrifugal blower in FIG. 1.

As shown in FIG. 3, the fan case 5 is molded in a spiral shape with a tongue portion 11 serving as the origin; forms a top-bottom pair with the motor case 8 to be joined therewith into a single unit; and is provided with the air outlet 4 that is extended in a tangential direction from the end tail of the spiral shape. The air inlet is provided at the top surface of the fan case 5, and the motor support cylinder 6, in which the fan motor 3 for rotationally driving the centrifugal fan 2 (see FIG. 1) is accommodated, and the motor flange 7 are joined to the bottom surface of the fan case 5.

As shown in FIG. 1, the centrifugal fan 2 is formed of a hub 10 having a disc shape whose center portion is raised toward the air inlet, a plurality of fins (also referred to as blades, vanes, and so forth) 12 that are arranged in a radiating manner at outer circumferential portions of the hub 10 (see FIG. 3), and a ring-shaped shroud (not shown) provided at ends of these fins 12 that face the hub 10. A boss portion 13 is provided at the center portion of the hub 10, and, by fixing the boss portion 13 to a shaft end of a rotating shaft 9, the centrifugal fan 2 is rotationally driven by means of the fan motor 3. Note that this centrifugal fan 2 is made of plastic.

The motor support cylinder 6 that accommodates the fan motor 3 has a substantially columnar shape and forms the motor case 8 together with the motor flange 7 that extends radially outward with respect to the motor support cylinder 6. The motor flange 7 is provided with a rib (ring-shaped rib portion) 20 in a substantially concentric manner with the motor support cylinder 6 so as to protrude from the motor flange 7 toward the top of the drawing.

In this rib 20, slits 22 (see FIG. 4) are provided at two (multiple) locations. The individual slits 22*a* and 22*b* are provided so as to be positioned within a range where the winding angle θ is equal to or greater than ±60° centered around the tongue portion 11 (see FIG. 3) when the fan case 5 and the motor case 8 are fitted together.

Here, generally, in a range where the winding angle θ is equal to or less than ±60° centered around the tongue portion 11, a reverse flow of water, a leakage flow from the tongue portion 11, and so forth make the flow unstable, and there is a known risk of water flowing toward the motor support cylinder 6 from the rib 20. Therefore, by providing the individual slits 22*a* and 22*b* within the range where the winding angle θ is equal to or greater than ±60° centered around the tongue portion 11, as in the present invention, it is possible to prevent water whose flow has been reversed from flowing toward the motor support cylinder 6 from the rib 20.

The slits 22*a* and 22*b* provided at the rib 20 extend from the motor flange 7 in the axial direction of the motor support cylinder 6 so as to reach an extension end portion 21 of the rib 20 (see FIG. 2), and the length thereof is equivalent to the length of the rib 20 in the extending direction (the length of the motor support cylinder 6 in the axial direction or the height of the rib 20). In addition, for the individual slits 22*a* and 22*b*, the respective slit widths (spaces in the circumferential direction) are set to be, for example, about 1 mm. By setting the slit widths in this way, it is possible to expel water toward the outer circumference of the rib 20 from between the rib 20 and the motor support cylinder 6 and it is also possible to suppress the water penetration into the space between the rib 20 and the motor support cylinder 6 from the slits 22*a* and 22*b*.

Note that, although the slit width of the individual slits 22*a* and 22*b* is described as being about 1 mm in this case, the slit width would be suitable so long as it is equal to or greater than 1 mm and equal to or less than 3 mm.

Furthermore, the height of the rib 20 is set so that a predetermined space can be formed between the extension end portion 21 of the rib 20 and the centrifugal fan 2 when the fan case 5 and the motor case 8 are fitted together.

The predetermined space referred to here is such that the extension end portion 21 of the rib 20 does not interfere with the centrifugal fan 2, and it is set to be, for example, about 2 mm or greater. By preventing the rib 20 from interfering with the centrifugal fan 2 in this way, the centrifugal fan 2 can be reliably operated when the centrifugal fan 2 is rotationally driven.

Figure 2:
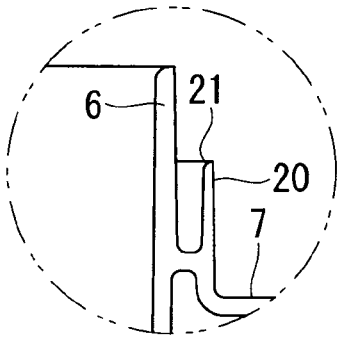
FIG. 2 is a partially enlarged view of a portion A shown in FIG. 1.

As shown in FIG. 2, the extension end portion 21 of the rib 20 has an R shape (downward inclined shape) that curves from the outer circumference of the rib 20 toward the inner circumference thereof. In other words, a curved portion (not shown) of the R shape of the extension end portion 21 is provided on the inner circumferential side of the rib 20, and a straight portion (not shown) of the R shape of the extension end portion 21 is formed flush with an outer circumferential wall of the rib 20. By forming the extension end portion 21 in such an R shape, when water penetrates from the outer circumferential side of the rib 20 toward the inner circumferential side of the rib 20 (between the rib 20 and the motor support cylinder 6), water is not retained at the R-shaped extension end portion 21 but drops to the inner circumferential side of the rib 20 along the curved portion (downward inclination) of the R shape.

Figure 5:
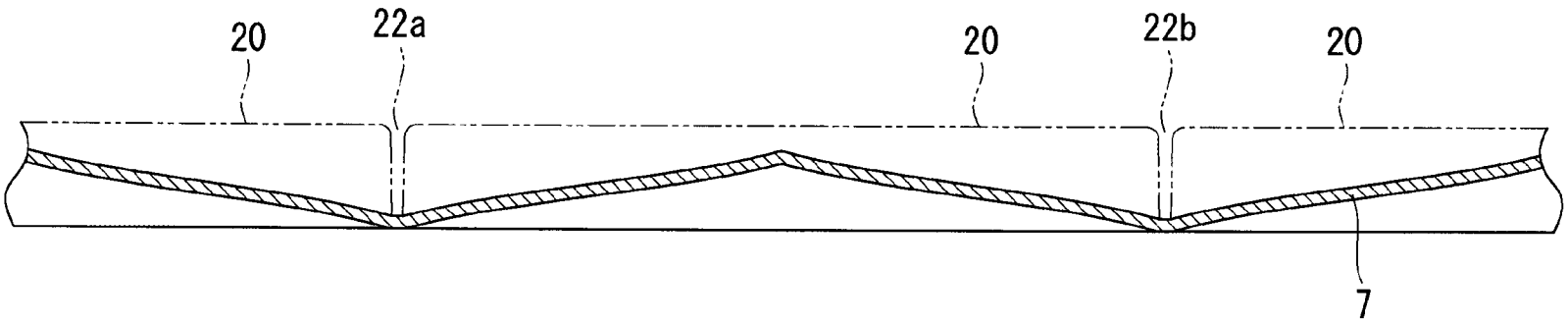
FIG. 5 is a cross-sectional view of a portion B-B in FIG. 4.

In addition, as shown in FIG. 5, the motor flange 7 that connects the rib 20 and the motor support cylinder 6 forms a downward inclination (inclination or slope) toward the individual slits 22*a* and 22*b* from a substantially center portion, in the circumferential direction, between the slit 22*a* and the slit 22*b*. By forming the motor flange 7 that connects the rib 20 and the motor support cylinder 6 as a slope in this way (see FIG. 2), water that has flowed into the space between the rib 20 and the motor support cylinder 6 can easily be guided along the sloping motor flange 7 toward the individual slits 22*a* and 22*b*.

As has been described above, the centrifugal blower 1 according to this embodiment affords the following operational advantages.

The motor flange (flange portion) 7 provided at the outer circumference of the motor support cylinder (cylinder) 6 that accommodates the fan motor (electric motor) 3 is provided with, in a substantially concentric manner with the motor support cylinder 6, the rib (ring-shaped rib portion) 20 that protrudes upward from the motor flange 7, and the rib 20 is provided with the slits 22*a* and 22*b* that extend from the motor flange 7 in the axial direction of the motor support cylinder 6. In addition, the motor flange 7 that connects the rib 20 and the motor support cylinder 6 is inclined downward (inclined) in the circumferential direction toward the slits 22*a* and 22*b*. By doing so, water guided into the space between the rib 20 and the motor support cylinder 6 can easily be guided to the slits 22*a* and 22*b* along the slope (inclination) so as to be discharged to the outer circumferential side of the rib 20. Therefore, it is possible to increase the water dischargeability of the centrifugal blower 1 even when the centrifugal blower 1 becomes inclined.

The rib 20 having the R-shaped (downward-inclined-shaped) extension end portion 21 that is curved from the outer circumference of the rib 20 toward the inner circumference thereof is employed. By doing so, when water enters the inner circumferential side of the rib 20 from the outer circumferential side of the rib 20, the straight portion of the R-shaped extension end portion 21 inhibits retention of water at the extension end portion 21 of the rib 20, and thus, water can easily be made to fall between the rib 20 and the motor support cylinder 6 along the curved portion (downward inclination) of the extension end portion 21. Accordingly, it is possible to suppress splashing toward the fan motor 3 due to spattering of water retained at the extension end portion 21 of the rib 20. Therefore, it is possible to suppress the water penetration into the fan motor 3.

The space between the centrifugal fan 2 and the extension end portion 21 of the rib 20 is set to be about 2 mm (predetermined space) when the fan case 5 and the motor case (electric motor case) 8 are fitted together. By doing so, it is possible to prevent the extension end portion 21 of the rib 20 from interfering with the centrifugal fan 2 when the centrifugal fan 2 is rotationally driven. Therefore, it is possible to reliably drive the centrifugal blower 1.

The respective slit widths of the individual slits 22*a* and 22*b* provided at the rib 20 are set to be about 1 mm (equal to or greater than 1 mm and equal to or less than 3 mm). By doing so, it is possible to easily expel water from between the rib 20 and the motor support cylinder 6, and it is also possible to prevent water penetration into the space between the rib 20 and the motor support cylinder 6 via the slits 22*a* and 22*b*. Therefore, it is possible to prevent water penetration toward the fan motor 3 and also to ensure sufficient water dischargeability of the centrifugal blower 1.

The rib 20 of the motor case 8 is provided with the slits 22*a* and 22*b* at positions within a range where the winding angle θ is equal to or greater than ±60° at the tongue portion 11 centered on the tongue portion 11 (outside of front and rear predetermined angles) when the motor case 8 and the fan case 5, which is molded in a spiral shape so as to surround the centrifugal fan 2 molded in a spiral shape, with the tongue portion 11 serving as the origin, are fitted together. By doing so, it is possible to prevent water penetration toward the fan motor 3 from the positions within the range where the winding angle θ is equal to or less than ±60° centered on the tongue portion 11 (vicinity of the tongue portion 11), where a reverse flow tends to occur. Therefore, it is possible to ensure sufficient water dischargeability from the centrifugal blower 1 and also to prevent water from penetrating the fan motor 3.

The centrifugal blower 1 from which water can be discharged even when inclined is employed. Therefore, it is possible to maintain the water dischargeability of a vehicle air conditioner (not shown) even when a vehicle (not shown) becomes inclined.

Note that, although the shape of the downward inclination of the extension end portion 21 has been described as being an R shape in this embodiment, the present invention is not limited thereto, and it is permissible to employ a straight C-surface shape that is inclined downward from the outer side of the rib 21 toward the inner side thereof.

REFERENCE SIGNS LIST

1 centrifugal blower
2 centrifugal fan
3 electric motor (fan motor)
4 air outlet
5 fan case
6 cylinder (motor support cylinder)
7 flange portion (motor flange)
8 electric motor case (motor case)
20 ring-shaped rib portion (rib)
22, 22*a*, 22*b* slit

The invention claimed is:

1. A centrifugal blower comprising:

a centrifugal fan;

an electric motor that rotationally drives the centrifugal fan;

a fan case that has an air inlet and an air outlet and that internally accommodates the centrifugal fan; and an electric motor case that has a cylinder accommodating the electric motor and a flange portion extending radially outward from the cylinder and that is fitted to the fan case, wherein an inner circumferential side of the flange portion is connected to the cylinder and is provided with, in a concentric manner with the cylinder, a ring-shaped rib portion that protrudes in an upward direction from the flange portion, and a groove portion for receiving water is provided between the inner circumferential side of the flange portion and an outer circumferential side of the cylinder;

the ring-shaped rib portion is provided with a slit that extends from the flange portion in the axial direction of the cylinder; and when an axis of the cylinder is oriented vertically, the flange portion between the ring-shaped rib portion and the cylinder is configured to form a downward inclination in a circumferential direction toward the slit.

2. A centrifugal blower according to claim 1, wherein an extension end portion of the ring-shaped rib portion is inclined downward from an outer circumference of the extension end portion toward an inner circumference thereof.

3. A centrifugal blower according to claim 1, wherein a predetermined space is formed between the extension end portion of the ring-shaped rib portion and the centrifugal fan when the fan case and the electric motor case are fitted together.

4. A centrifugal blower according to claim 1, wherein the width of the slit is equal to or greater than 1 mm and equal to or less than 3 mm.

5. A centrifugal blower according to claim 1, wherein the fan case is formed so as to surround the centrifugal fan in a spiral shape with a tongue portion thereof serving as the origin; and the slit is provided at a position outside of front and rear predetermined angles centered on the tongue portion when the fan case and the electric motor case are fitted together.

6. A vehicle air conditioner provided with a centrifugal blower according to claim 1.

* * * * *